US008970436B2

(12) United States Patent
Yang

(10) Patent No.: US 8,970,436 B2
(45) Date of Patent: Mar. 3, 2015

(54) SURFACE MOUNT DEVICE MULTI-FREQUENCY ANTENNA MODULE

(71) Applicant: Cirocomm Technology Corp., Tainan (TW)

(72) Inventor: Tsai-Yi Yang, Tainan (TW)

(73) Assignee: Circomm Technology Corp., Tainan (TW)

( * ) Notice: Subject to any disclaimer, the term of this patent is extended or adjusted under 35 U.S.C. 154(b) by 230 days.

(21) Appl. No.: 13/828,916

(22) Filed: Mar. 14, 2013

(65) Prior Publication Data

US 2014/0266972 A1 Sep. 18, 2014

(51) Int. Cl.

| | |
|---|---|
| ***H01Q 1/38*** | (2006.01) |
| ***H01Q 1/24*** | (2006.01) |
| ***H01Q 5/00*** | (2006.01) |
| ***H01Q 9/42*** | (2006.01) |

(52) U.S. Cl.

CPC ..... *H01Q 1/243* (2013.01); *H01Q 1/38* (2013.01); *H01Q 5/0058* (2013.01); *H01Q 5/0065* (2013.01); *H01Q 9/42* (2013.01)

USPC ..... 343/700 MS; 343/702

(58) Field of Classification Search

CPC ..... H01Q 1/243; H01Q 1/38; H01Q 5/0065

USPC ..... 343/702, 700 MS

See application file for complete search history.

(56) References Cited

U.S. PATENT DOCUMENTS

| | | | | |
|---|---|---|---|---|
| 6,680,700 | B2 * | 1/2004 | Hilgers | 343/700 MS |
| 7,196,667 | B2 * | 3/2007 | Watada et al. | 343/700 MS |
| 2006/0017621 | A1 * | 1/2006 | Okawara et al. | 343/700 MS |
| 2010/0127940 | A1 * | 5/2010 | Harihara et al. | 343/700 MS |

* cited by examiner

*Primary Examiner* — Hoang V Nguyen

(74) *Attorney, Agent, or Firm* — Muncy, Geissler, Olds & Lowe, P.C.

(57) ABSTRACT

A surface mount device multi-frequency antenna module includes a base plate, a carrier, a first ground layer, a first signal feed-in line, a second signal feed-in line, and a third signal feed-in line, wherein the last four parts are arranged on the base plate. The carrier includes a first radiator, a second radiator, a third radiator, and a fourth radiator. The first radiator is electrically connected to the second radiator. The first radiator is not electrically connected to the third radiator and the fourth radiator. A contact connecting the first radiator and the second radiator is electrically connected to the first signal feed-in line when the carrier is electrically connected to the base plate. The third radiator is electrically connected to the second signal feed-in line. The fourth radiator is electrically-connected to the third signal feed-in line.

10 Claims, 10 Drawing Sheets

| | 700 MHz | 824 MHz | 960 MHz | 1710 MHz | 2170 MHz |
|---|---|---|---|---|---|
| Reture Loss | -3.98 | -11.66 | -5.57 | -10.39 | -6.38 |
| SWR | 4.20 | 1.73 | 3.02 | 1.76 | 2.88 |

FIG.8C

| long-term evolution antenna parameters table | | | | | | | | | | | |
|---|---|---|---|---|---|---|---|---|---|---|---|
| Band | GSM (MHz) | | | | | DCS (MHz) | | PCS (MHz) | | WCDMA (MHz) | |
| | 700 | 824 | 880 | 890 | 960 | 1710 | 1880 | 1850 | 1990 | 2110 | 2170 |
| Peak Gain (dBi) | -4.0 | 2.21 | 2.49 | 2.56 | 2.32 | 3.88 | 4.5 | 4.76 | 5.22 | 4.28 | 3.07 |
| Efficiency (%) | 40.09 | 66.97 | 70.48 | 68.10 | 63.76 | 70.35 | 70.32 | 71.97 | 82.60 | 67.04 | 58.29 |

FIG.9

SURFACE MOUNT DEVICE MULTI-FREQUENCY ANTENNA MODULE

BACKGROUND OF THE INVENTION

1. Field of the Invention

The present invention relates to an antenna module, and especially relates to a high-gain multi-frequency antenna module.

2. Description of the Related Art

The wireless communication technology is progressing every day. Many portable electronic apparatuses, such as notebooks, smart phones, and tablet PCs, are slim and light. Therefore, the antennas for the portable electronic apparatuses are small, too. Or, the structures of the antennas have to be modified, so that the antennas can be arranged into the portable electronic apparatuses.

The planar inverted-f antenna (PIFA) is the most common multi-frequency antenna. The PIFA is designed in two-dimension and is made of copper printed on the printed circuit board. Or the PIFA is designed in three-dimension and is made of foil stamped with the stamping technology.

The structure of the PIFA mentioned above (both designed in two-dimension and three-dimension) can be modified, so that the PIFA can receive dual-band and tri-band wireless signals. In order to maintain the performance of the antenna, the volume of the PIFA is usually not small, so that the space for arranging the PIFA into the portable electronic apparatus is not small. However, if the space for arranging the PIFA into the portable electronic apparatus is not small, the portable electronic apparatus will not be slim and light.

SUMMARY OF THE INVENTION

In order to solve the above-mentioned problems, an object of the present invention is to provide a surface mount device multi-frequency antenna module which is slim and light. The surface mount device multi-frequency antenna module includes a carrier which is made of ceramic with high dielectric constant.

In order to achieve the object of the present invention mentioned above, the surface mount device multi-frequency antenna module includes a base plate, the carrier, a first ground layer, a first signal feed-in line, a first gap, a second signal feed-in line, a second gap, a third signal feed-in line, and a third gap. The base plate includes a first surface and a second surface. The first ground layer and the first signal feed-in line are arranged on the first surface. The first gap is formed between the first signal feed-in line and the first ground layer. The second signal feed-in line is electrically connected to the first ground layer and is on a left side of the first signal feed-in line. The second gap is formed between the second signal feed-in line and the first signal feed-in line. The third signal feed-in line is electrically connected to the first ground layer and is on a right side of the first signal feed-in line. The third gap is formed between the third signal feed-in line and the first signal feed-in line.

The carrier includes a first radiator, a second radiator, a third radiator, and a fourth radiator. The first radiator is electrically connected to the second radiator. The first radiator is not electrically connected to the third radiator and the fourth radiator.

A contact connecting the first radiator and the second radiator is electrically connected to the first signal feed-in line when the carrier is electrically connected to the base plate. The third radiator is electrically connected to the second signal feed-in line. The fourth radiator is electrically connected to the third signal feed-in line.

Moreover, the first signal feed-in line includes a front segment, a rear segment, and a perforation. The perforation is at the front segment. The front segment is prolonged forward to the first ground layer. The first gap is formed between the front segment and the first ground layer. A width of the second gap formed between the rear segment and the second signal feed-in line is adjusted for adjusting a coupling capacitance, so that the first ground layer provides a resonance point of high frequency. A width of the third gap formed between the rear segment and the third signal feed-in line is adjusted for adjusting the coupling capacitance, so that the first ground layer provides the resonance point of high frequency. The surface mount device multi-frequency antenna module further includes two fixed contacts mounted on the first surface and opposite to each other. The fixed contacts are electrically connected to the first radiator and the second radiator. The surface mount device multi-frequency antenna module further includes a second ground layer arranged on the second surface. The carrier is made of cuboid ceramic with high dielectric constant. The first radiator, the second radiator, the third radiator, and the fourth radiator are made of different rectangle metal patterns and line metal patterns arranged on at least one surface of the carrier. The surface mount device multi-frequency antenna module further includes a connecting unit. The connecting unit includes a connector and a signal feed-in probe. The signal feed-in probe is arranged inside the connector. The signal feed-in probe is electrically connected to the first signal feed-in line through the perforation.

BRIEF DESCRIPTION OF DRAWING

FIG. 8C shows a table for FIG. 8B.

FIG. 9 shows a table for long-term evolution antenna peak gain parameters of the present invention.

DETAILED DESCRIPTION OF THE INVENTION

Figure 1:
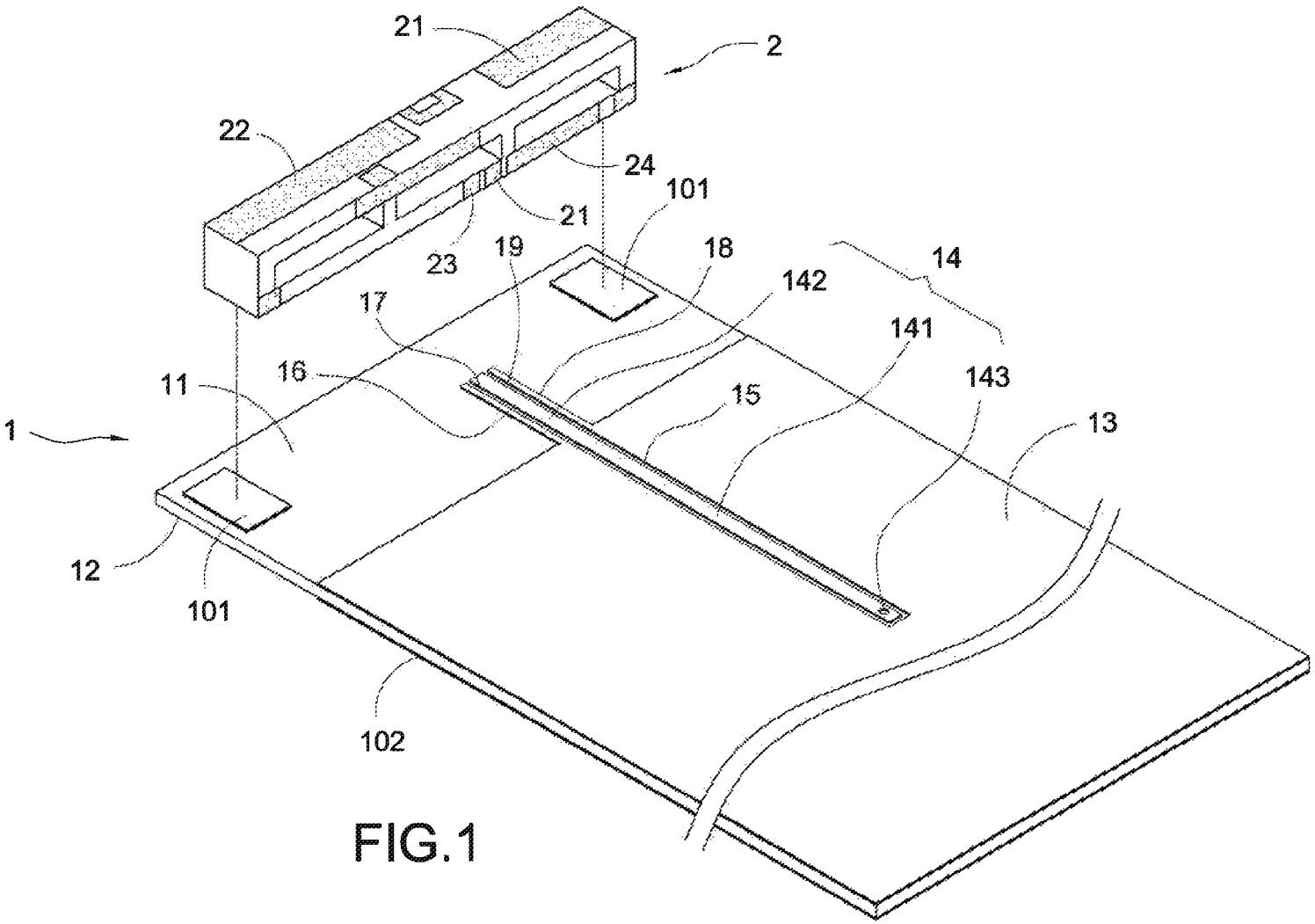
FIG. 1 shows an exploded view of the multi-frequency antenna module of the present invention.
Figure 2:
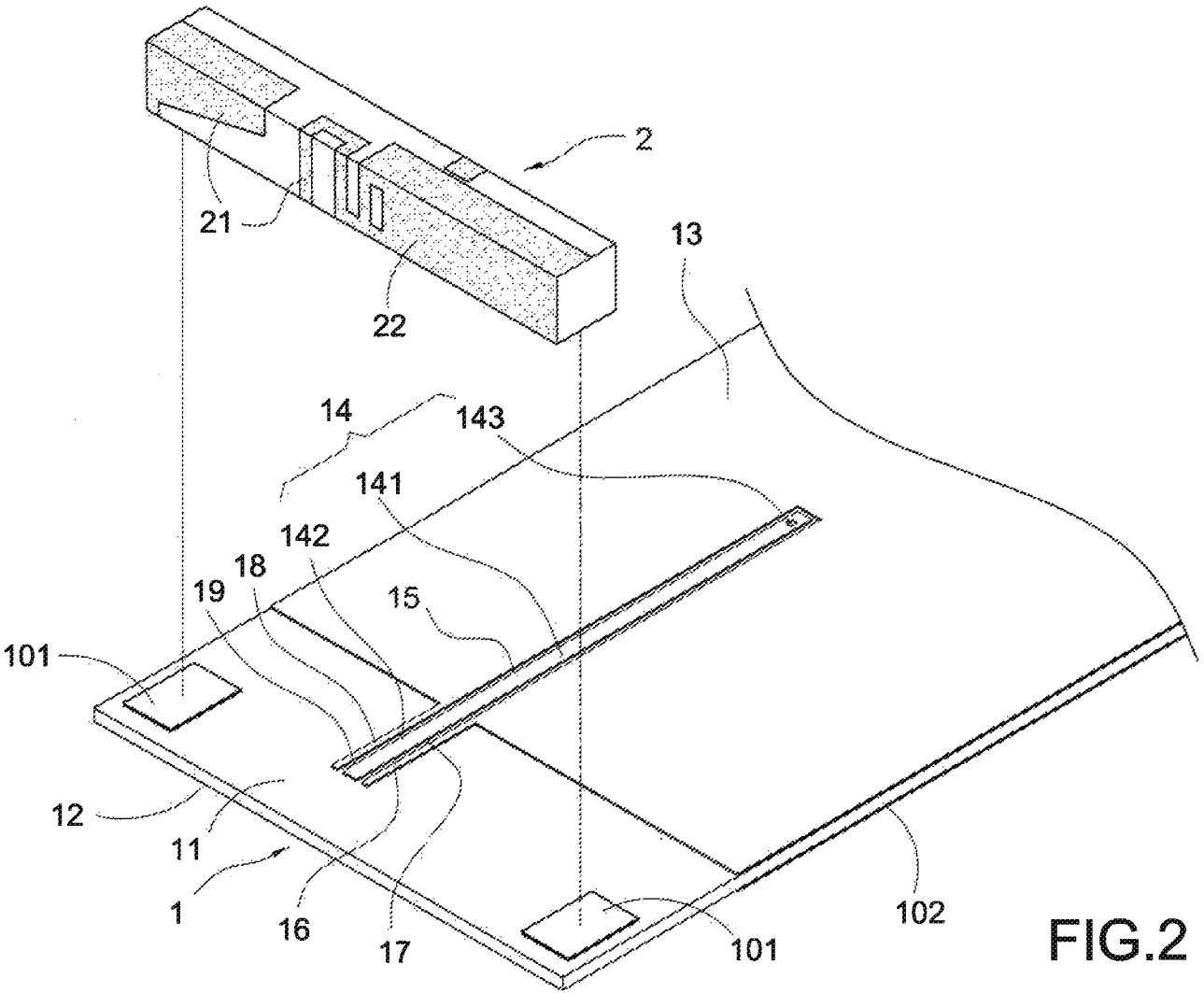
FIG. 2 shows another exploded view of the multi-frequency antenna module of the present invention.
Figure 3:
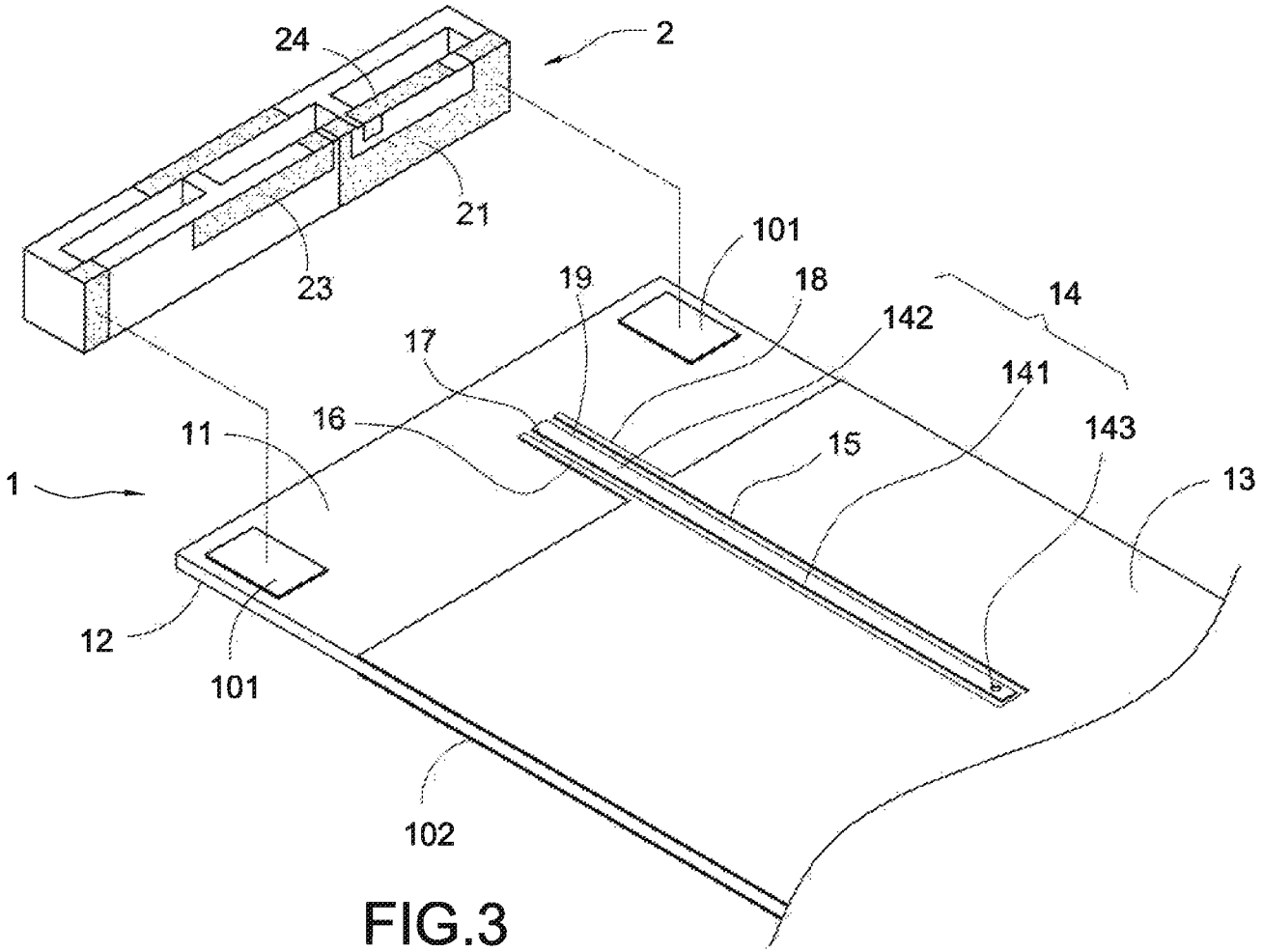
FIG. 3 shows still another exploded view of the multi-frequency antenna module of the present invention.
Figure 4:
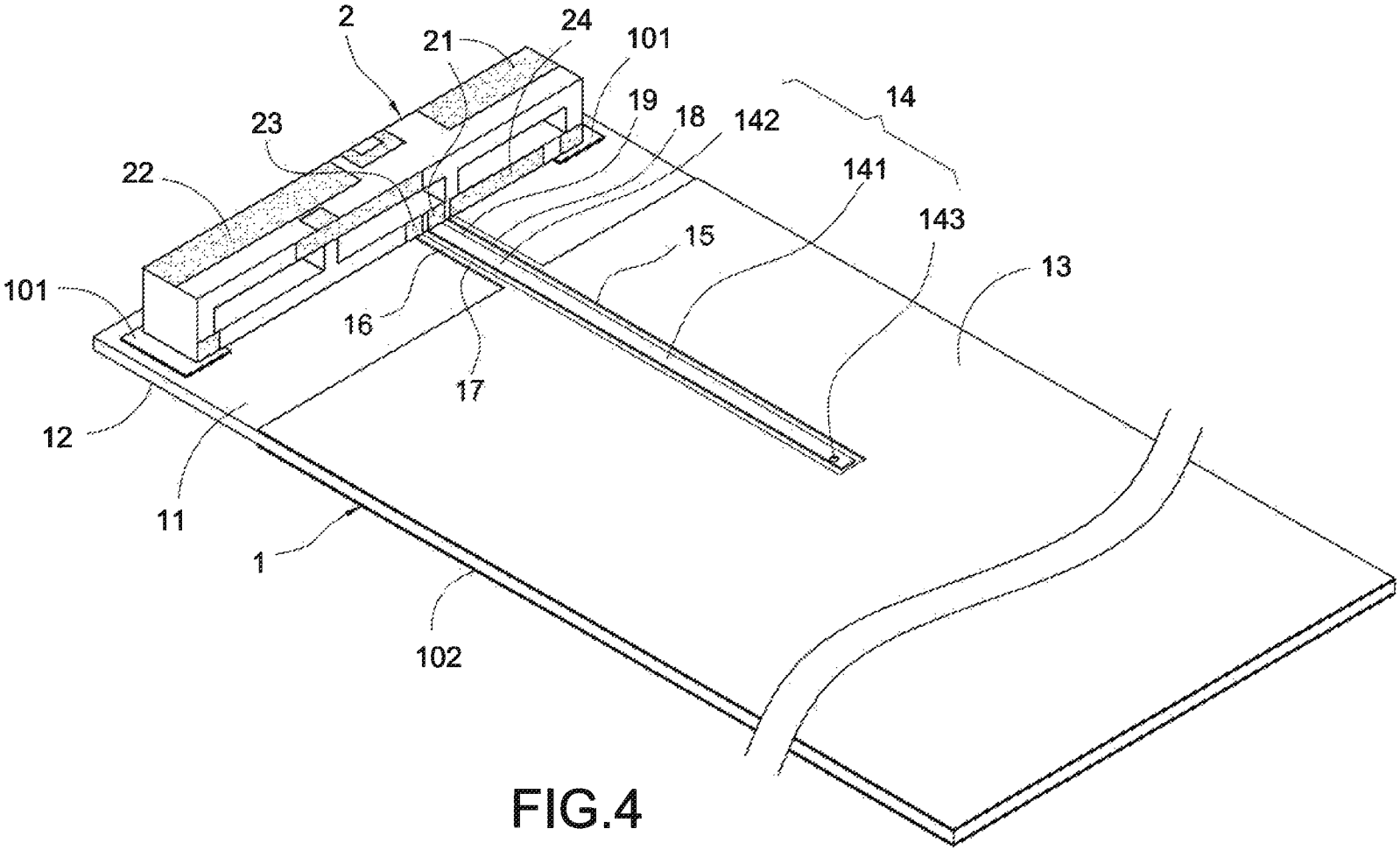
FIG. 4 shows an assembly drawing of the multi-frequency antenna module of the present invention.

FIG. 1 shows an exploded view of the multi-frequency antenna module of the present invention. FIG. 2 shows another exploded view of the multi-frequency antenna module of the present invention. FIG. 3 shows still another exploded view of the multi-frequency antenna module of the present invention. FIG. 4 shows an assembly drawing of the multi-frequency antenna module of the present invention. A surface mount device (SMD) multi-frequency antenna module includes a base plate 1, a carrier 2, a first ground layer 13, a first signal feed-in line 14, a first gap 15, a second signal feed-in line 16, a second gap 17, a third signal feed-in line 18, and a third gap 19.

The base plate 1 includes a first surface 11 and a second surface 12. The first ground layer 13 and the first signal feed-in line 14 are arranged on the first surface 11. The first signal feed-in line 14 includes a front segment 141, a rear segment 142, and a perforation 143. The perforation 143 is at the front segment 141. The front segment 141 is prolonged forward to the first ground layer 13. The first gap 15 is formed between the front segment 141 and the first ground layer 13. The second signal feed-in line 16 is electrically connected to the first ground layer 13 and is on a left side of the rear segment 142. The second gap 17 is formed between the second signal feed-in line 16 and the rear segment 142. A width of the second gap 17 formed between the rear segment 142 and the second signal feed-in line 16 is adjusted for adjusting a coupling capacitance, so that the first ground layer 13 provides a resonance point of high frequency. Therefore, the bandwidth is increased. The third signal feed-in line 18 is electrically connected to the first ground layer 13 and is on a right side of the rear segment 142. The third gap 19 is formed between the third signal feed-in line 18 and the rear segment 142. A width of the third gap 19 formed between the rear segment 142 and the third signal feed-in line 18 is adjusted for adjusting the coupling capacitance, so that the first ground layer 13 provides the resonance point of high frequency. Therefore, the bandwidth is increased. Moreover, the surface mount device multi-frequency antenna module further includes two fixed contacts 101 mounted on the first surface 11 and opposite to each other. The carrier 2 is fixedly mounted on the fixed contacts 101. The surface mount device multi-frequency antenna module further includes a second ground layer 102 arranged on the second surface 12. Moreover, a ground part of a coaxial cable connector of a coaxial cable (not shown in FIGS. 1, 2, 3, and 4) is electrically connected to the second ground layer 102.

Figure 5:
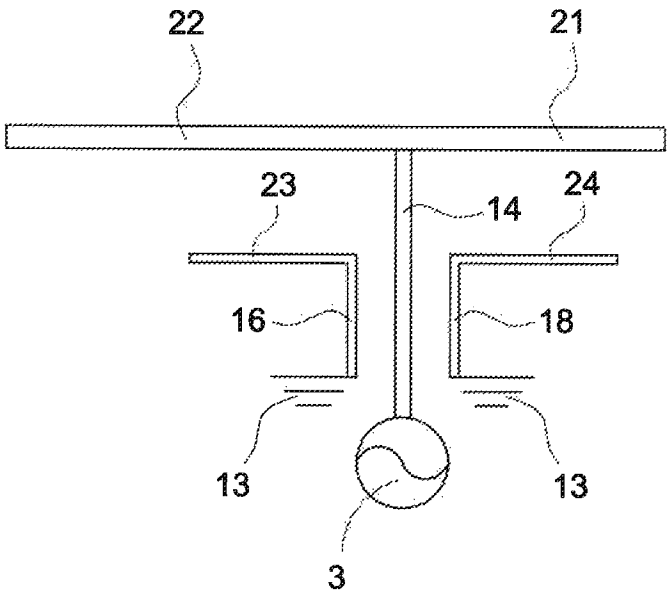
FIG. 5 shows a circuit diagram of the multi-frequency antenna module of the present invention.

The carrier 2 is of cubic shape and made of ceramic with high dielectric constant. The carrier 2 includes a first radiator 21, a second radiator 22, a third radiator 23, and a fourth radiator 24. The first radiator 21, the second radiator 22, the third radiator 23, and the fourth radiator 24 are made of different rectangle metal patterns and line metal patterns arranged on at least one surface of the carrier 2. Therefore, the volume of the antenna is minimized. The first radiator 21 is electrically connected to the second radiator 22. The first radiator 21 is not electrically connected to the third radiator 23 and the fourth radiator 24. The fixed contacts 101 are electrically connected to the first radiator 21 and the second radiator 22 when the carrier 2 is electrically connected to the base plate 1. Therefore, the carrier 2 is fixedly connected to the first surface 11. Moreover, a contact connecting the first radiator 21 and the second radiator 22 is electrically connected to the first signal feed-in line 14. The third radiator 23 is electrically connected to the second signal feed-in line 16. The fourth radiator 24 is electrically connected to the third signal feed-in line 18. FIG. 5 shows a circuit diagram of the multi-frequency antenna module of the present invention. The first radiator 21 and the second radiator 22 are electrically connected to the first signal feed-in line 14. Therefore, the first radiator 21 is a first antenna, and the second radiator 22 is a second antenna. The third radiator 23 is electrically connected to the second signal feed-in line 16. Therefore, the third radiator 23 is a third antenna. The third signal feed-in line 18 is electrically connected to the fourth radiator 24. Therefore, the fourth radiator 24 is a fourth antenna.

A signal source 3 is transmitted to the first radiator 21 and the second radiator 22 through the first signal feed-in line 14 to form the high frequency resonance structure and the low frequency resonance structure. The width of the second gap 17 formed between the first signal feed-in line 14 and the second signal feed-in line 16 is adjusted for adjusting the coupling capacitance, so that the first ground layer 13 provides the resonance point of high frequency. Therefore, the bandwidth is increased. Similarly, the width of the third gap 19 formed between the first signal feed-in line 14 and the third signal feed-in line 18 is adjusted for adjusting the coupling capacitance, so that the first ground layer 13 provides the resonance point of high frequency. Therefore, the bandwidth is increased.

Figure 6:
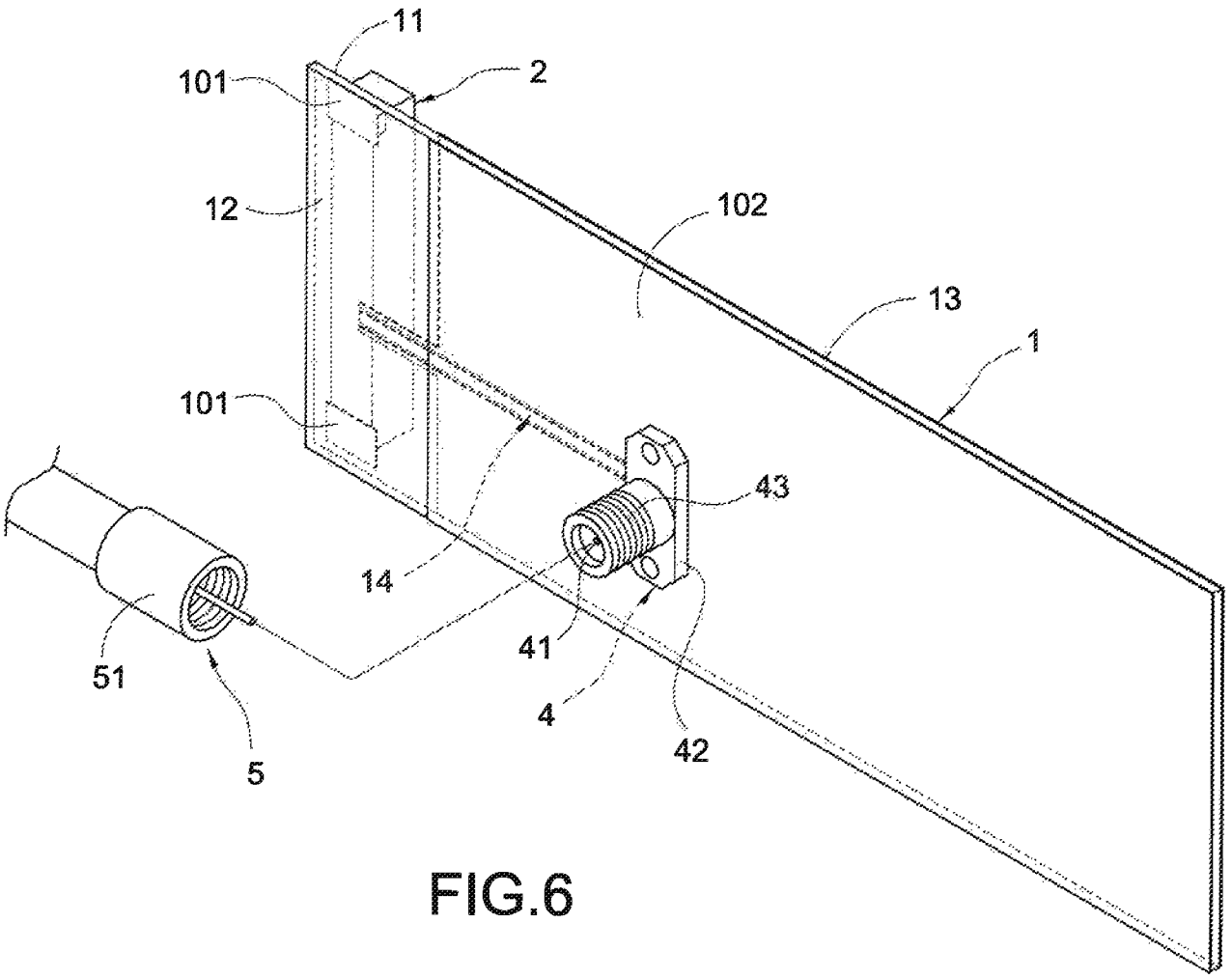
FIG. 6 shows a diagram showing how the multi-frequency antenna module of the present invention is used.
Figure 7:
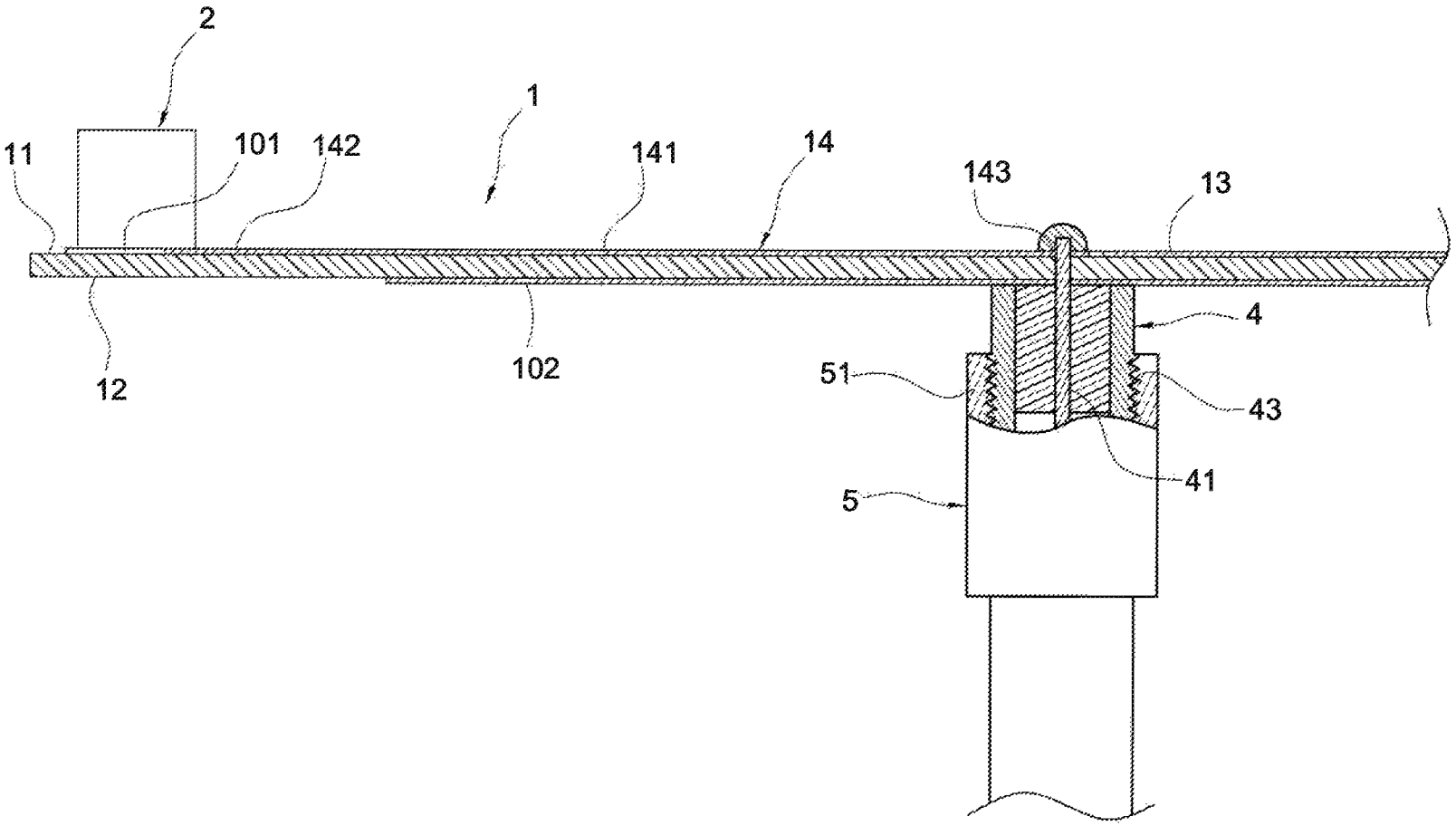
FIG. 7 shows a side cross-sectional view of FIG. 6.

FIG. 6 shows a diagram showing how the multi-frequency antenna module of the present invention is used. FIG. 7 shows a side cross-sectional view of FIG. 6. A signal feed-in probe 41 of a connecting unit 4 connected to a coaxial cable 5 is electrically connected to the first signal feed-in line 14 through the perforation 143. A connector 42 of the connecting unit 4 is electrically connected to the second ground layer 102.

A coaxial cable connector 51 of the coaxial cable 5 is screwed to a thread 43 of the connector 42. The first radiator 21, the second radiator 22, the third radiator 23, and the fourth radiator 24 receive wireless signals with different bands. Therefore, the antenna module of the present invention is used as a multi-frequency antenna module.

Figure 8A:
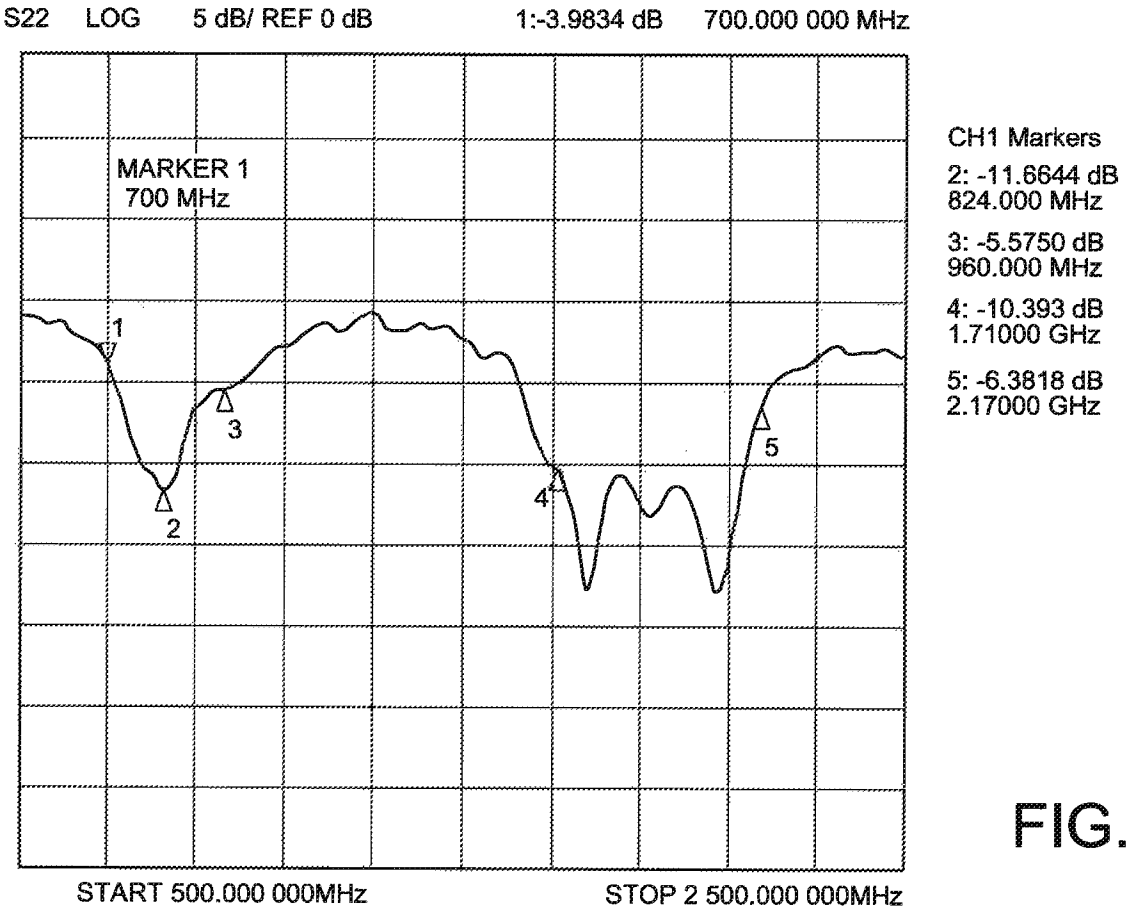
FIG. 8A shows a frequency response curve of the present invention.
Figure 8B:
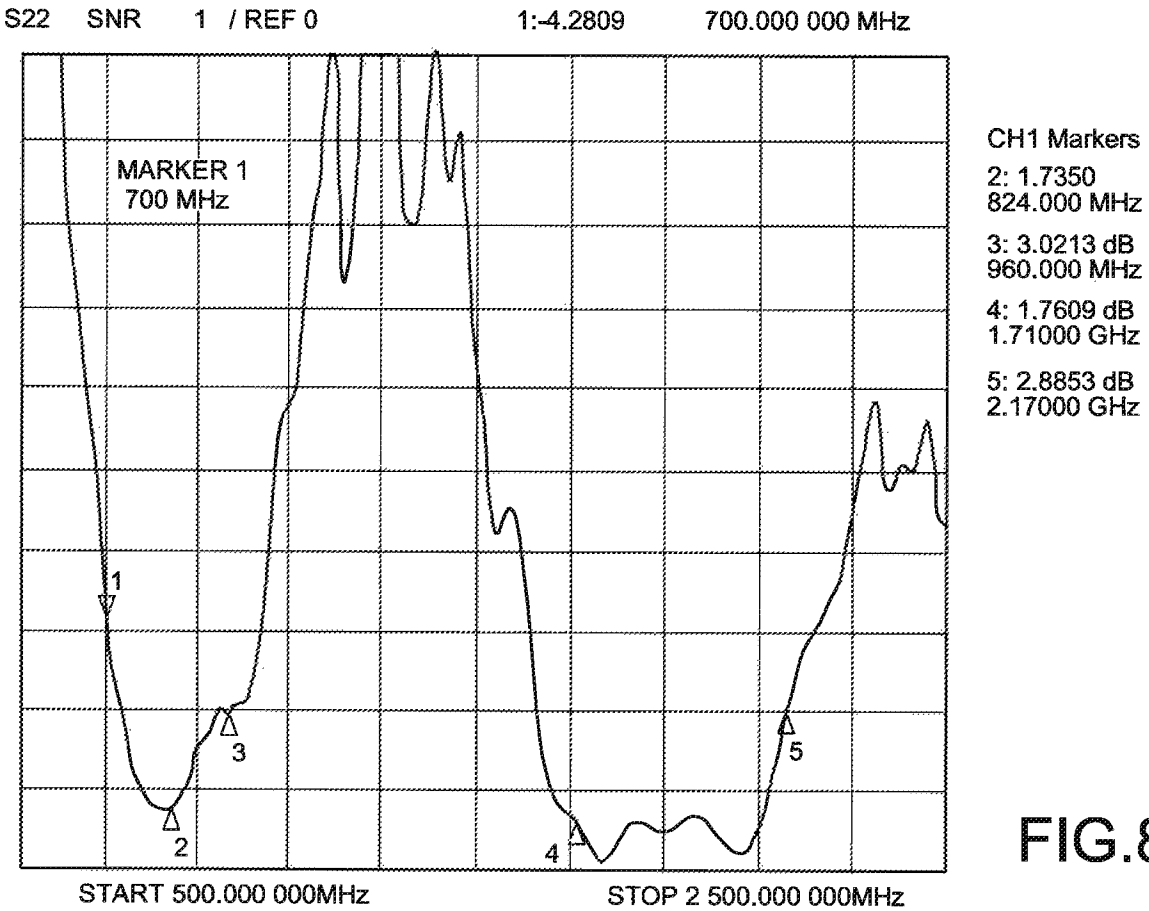
FIG. 8B shows a frequency response curve of the present invention.

FIG. 8A shows a frequency response curve of the present invention. FIG. 8B shows a frequency response curve of the present invention. FIG. 8C shows a table for FIG. 8A and FIG. 8B. The return loss is −3.98 and the standing wave ratio (SWR) is 4.20 when the frequency of the multi-frequency antenna module is 700 MHz.

The return loss is −11.66 and the SWR is 1.73 when the frequency of the multi-frequency antenna module is 824 MHz. The return loss is −5.57 and the SWR is 3.02 when the frequency of the multi-frequency antenna module is 960 MHz. The return loss is −10.39 and the SWR is 1.76 when the frequency of the multi-frequency antenna module is 1710 MHz. The return loss is −6.38 and the SWR is 2.88 when the frequency of the multi-frequency antenna module is 2170 MHz.

FIG. 9 shows a table for long-term evolution antenna peak gain parameters of the present invention. The surface mount device multi-frequency antenna module of the present invention is slim, light, high efficiency, and suitable for long-term evolution (LTE) and fourth-generation communication systems. The bands of the present invention include 700~960 MHz, 1710~2170 MHz, and so on, for LTE, global system for mobile communications (GSM), digital communications system (DCS), personal communication system (PCS), and wideband code division multiple access (WCDMA).

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A surface mount device multi-frequency antenna module including:

a base plate having a first surface and a second surface;

a first ground layer arranged on the first surface;

a first signal feed-in line arranged on the first surface;

a first gap formed between the first signal feed-in line and the first ground layer;

a second signal feed-in line electrically connected to the first ground layer and on a left side of the first signal feed-in line;

a second gap formed between the second signal feed-in line and the first signal feed-in line;

a third signal feed-in line electrically connected to the first ground layer and on a right side of the first signal feed-in line;

a third gap formed between the third signal feed-in line and the first signal feed-in line; and a carrier having a first radiator, a second radiator, a third radiator, and a fourth radiator, the first radiator electrically connected to the second radiator, the first radiator not electrically connected to the third radiator and the fourth radiator, wherein a contact connecting the first radiator and the second radiator is electrically connected to the first signal feed-in line when the carrier is electrically connected to the base plate; the third radiator is electrically connected to the second signal feed-in line; the fourth radiator is electrically connected to the third signal feed-in line.

2. The surface mount device multi-frequency antenna module in claim 1, wherein the first signal feed-in line includes a front segment, a rear segment, and a perforation; the perforation is at the front segment; the front segment is prolonged forward to the first ground layer; the first gap is formed between the front segment and the first ground layer.

3. The surface mount device multi-frequency antenna module in claim 2, wherein the second gap formed between the rear segment and the second signal feed-in line has an adjusted width for adjusting a coupling capacitance, so that the first ground layer provides a resonance point of high frequency.

4. The surface mount device multi-frequency antenna module in claim 3, wherein the third gap formed between the rear segment and the third signal feed-in line has an adjusted width for adjusting the coupling capacitance, so that the first ground layer provides the resonance point of high frequency.

5. The surface mount device multi-frequency antenna module in claim 4, further including two fixed contacts mounted on the first surface and opposite to each other, wherein the fixed contacts are electrically connected to the first radiator and the second radiator.

6. The surface mount device multi-frequency antenna module in claim 5, further including a second ground layer arranged on the second surface.

7. The surface mount device multi-frequency antenna module in claim 6, wherein the carrier is of cubic shape and made of ceramic with high dielectric constant.

8. The surface mount device multi-frequency antenna module in claim 7, wherein the first radiator, the second radiator, the third radiator, and the fourth radiator are made of different rectangle metal patterns and line metal patterns arranged on the carrier.

9. The surface mount device multi-frequency antenna module in claim 8, wherein the rectangle metal patterns and line metal patterns are arranged on at least one surface of the carrier.

10. The surface mount device multi-frequency antenna module in claim 9, further including:

a connecting unit having a connector and a signal feed-in probe, wherein the signal feed-in probe is arranged inside the connector; the signal feed-in probe is electrically connected to the first signal feed-in line through the perforation.

* * * * *

UNITED STATES PATENT AND TRADEMARK OFFICE

CERTIFICATE OF CORRECTION

PATENT NO. : 8,970,436 B2
APPLICATION NO. : 13/828916
DATED : March 3, 2015
INVENTOR(S) : Tsai-Yi Yang It is certified that error appears in the above-identified patent and that said Letters Patent is hereby corrected as shown below:

Title Page, item (73)

Please correct the name of the Assignee from "Circomm Technology Corp." to --Cirocomm Technology Corp.--.

Signed and Sealed this
First Day of December, 2015

Michelle K. Lee

Michelle K. Lee
*Director of the United States Patent and Trademark Office*